United States Patent [19]

Broszat

[11] Patent Number: 4,486,730

[45] Date of Patent: Dec. 4, 1984

[54] DISC COIL WINDING OF INTERWOUND SINGLE OR DOUBLE COILS

[75] Inventor: Gottfried Broszat, Waiblingen-Hegnach, Fed. Rep. of Germany

[73] Assignee: Transformatoren Union Aktiengesellschaft, Stuttgart, Fed. Rep. of Germany

[21] Appl. No.: 431,625

[22] Filed: Sep. 30, 1982

[30] Foreign Application Priority Data

Mar. 15, 1982 [DE] Fed. Rep. of Germany ..... 3209350

[51] Int. Cl.[3] ..... H01F 15/14

[52] U.S. Cl. ..... 336/69; 336/70; 336/186; 336/187

[58] Field of Search ..... 336/69, 70, 186, 187

[56] References Cited

U.S. PATENT DOCUMENTS

| | | | |
|---|---|---|---|
| 2,862,195 | 11/1958 | Kury | 336/69 X |
| 2,905,911 | 9/1959 | Kurita | 336/70 |
| 3,160,838 | 12/1964 | Bedil | 336/69 |
| 3,560,902 | 2/1971 | Okuyama | 336/70 |

FOREIGN PATENT DOCUMENTS

| | | | |
|---|---|---|---|
| 1069279 | 6/1954 | Fed. Rep. of Germany | 336/69 |
| 477183 | 12/1968 | Japan | 336/70 |

*Primary Examiner*—A. D. Pellinen

*Assistant Examiner*—Susan Steward

*Attorney, Agent, or Firm*—Herbert L. Lerner; Laurence A. Greenberg

[57] ABSTRACT

A disc coil winding of interwound coils is formed of winding conductors covered with normal insulation, the winding having a radially inner and a radially outer surface. A plurality of the coils are disposed at an input to the winding, and have respective turns thereof located at the inner and the outer surface of the winding as well as respective turns thereof located radially adjacent thereto. Supplemental insulations are provided for reinforcing the normal insulation, the supplemental insulations extending from respective starting locations both between the turn located at the inner surface and the turn adjacent thereto as well as between the turn located at the outer surface and the turn adjacent thereto for protecting at least one edge of the respective turns. The coils have a turn capacitance between respective turns thereof free of the supplemental insulations which is greater than the turn capacitance between the respective turns thereof provided with the supplemental insulations. The supplemental insulations are formed as a spacer having a substantially rectangular cross section disposed radially between the respective turns to be supplementarily insulated, the spacer having a width in axial direction equal to the corresponding width of one of the winding conductors covered with normal insulation.

8 Claims, 7 Drawing Figures

DISC COIL WINDING OF INTERWOUND SINGLE OR DOUBLE COILS

FIELD OF THE INVENTION

The invention relates to a disc coil winding of interwound single or double coils.

BACKGROUND OF THE INVENTION

In copending application Ser. No. 346,880, filed Feb. 8, 1982 of the inventor of the instant application, it was proposed to insulate mutually, in interwound coils with increasingly heavily insulated shell or casing surfaces, at least two turns, respectively, in the input region, at the inner and outer rim additionally so that one edge is surrounded angularly by this supplemental insulation and the turn capacity between turns with normal insulation is greater than between turns with supplemental insulations.

By this arrangement, the field intensity in the most highly stressed oil wedges or corners between the edge turns and the adjacent turns is shifted away from the conductor by lining with solid insulation and reaches the order of magnitude of the field intensity at the more highly insulated edges at the casing surface. The formed rings thereby introduced, for example, with U or L-shaped cross section, represent a relatively great expense which is justified only for very high voltages. This is true also if the formed rings are made by additionally covering or encasing the winding conductors with insulating paper and surrounding the edge conductors on all sides.

With voltages which are not so extremely high, the stress of the edge insulation at the casing surface of the winding may already be lower than the stress by the voltage between adjacent turns in high-voltage windings without additionally insulated casing surfaces. Also thereby great reliability against longitudinal breakdowns as well as the reliability achieved primarily by the normal insulation of the conductors against breakdowns between adjacent turns is adjustable by the supplemental insulation according to the aforementioned earlier patent application of the inventor of the instant application. The construction of the supplemental insulation out of formed rings, however, is relatively even more expensive than in windings with increased insulation on the cylinder surfaces.

It is therefore an object of the invention to provide, for high voltage windings of disc coils in transformers with and without increased insulation of the shell or casing surfaces of the winding, an arrangement and design of disc(flat) coils, wherein the safety or reliability of the insulation against longitudinal sparkovers over several disc coils is somewhat equal to the safety or reliability of the turn insulation against breakdowns, without incurring appreciable additional costs.

SUMMARY OF THE INVENTION

With the foregoing and other objects in view, there is provided, in accordance with the invention, a disc coil winding of interwound individual or double coils, comprising supplemental insulations for reinforcing normal insulation, at least in coils of the winding located at an entrance to the winding starting from an inner and an outer casing surface thereof, between at least two respective turns, the supplemental insulations protecting at least one edge of the respective turns so that turn capacity between turns free of supplemental insulation is greater than turn capacity between the turns equipped with supplemental insulation, the respective supplemental insulation being reduced to a spacer having a substantially rectangular cross section disposed radially between turns to be insulated additionally, the spacer having a width in axial direction equal to the corresponding width of a winding conductor covered with normal insulation.

In accordance with another feature of the invention the sum of the radial dimensions of the supplemental insulations per disc coil is equal to the radial thickness of the normally insulated winding conductor.

In accordance with an alternate feature of the invention the sum of the radial dimensions of the supplemental insulations per disc coil is equal to an integral multiple of the radial thickness of the normally insulated winding conductor.

To ensure economy and, in accordance with a further feature of the invention spacing of metal between radially adjacent turns established by the supplemental insulation decreases with increasing spacing of the corresponding disc coils from high-voltage input at the winding.

In accordance with an additional feature of the invention the supplemental insulation is formed of solid insulating strips.

In accordance with alternate features of the invention the supplemental insulation is formed of cooling channel strips or the supplemental insulation is formed of a combination of solid insulating strips and cooling channel strips. Accordingly, a graduating insulation is produced at which, under surge voltage stresses, the field intensities in the oil are approximately equal at the coil edges and between the turns.

In accordance with a concomitant feature of the invention the supplemental insulations are disc-shaped serving as equalizing discs, and being disposed in axial direction between adjacent disc coils in a manner that a radial oil channel between a respective pair of adjacent disc coils, having different radial dimensions has the same axial height as a radial oil channel between adjacent disc coils having the same radial dimensions.

The further development of the subject of applicant's aforementioned earlier application is very advantageous because it ensures, through simplication, an economical construction and application of the supplemental insulation required in special cases. Other features which are considered as characteristic for the invention are set forth in the appended claims.

Although the invention is illustrated and described herein as embodied in a disc coil winding of interwound single or double coils, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF THE INVENTION

Like parts are provided with the same reference characters in all of the figures.

DESCRIPTION OF THE PREFERRED EMBODIMENTS

Figure 1:
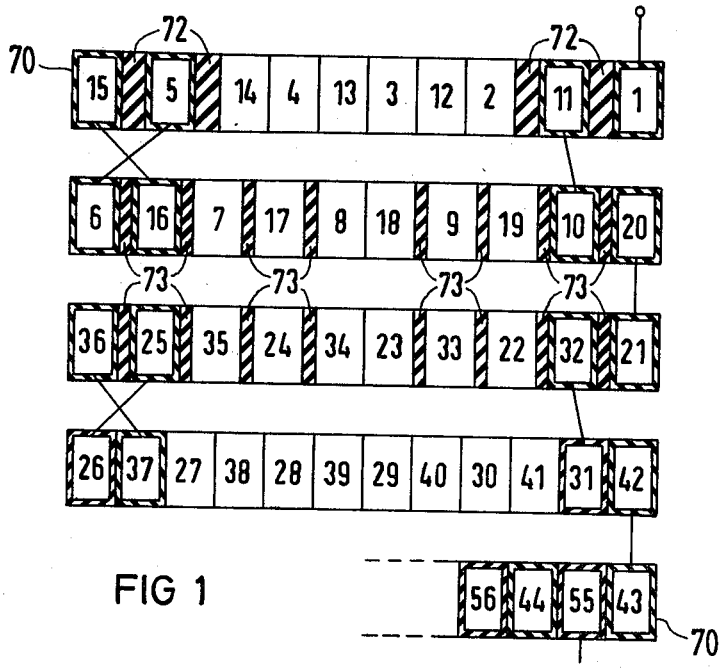
FIG. 1 is a diagrammatic view of a supplemental insulation of the same total thickness in each of three disc coils.
Figure 2:
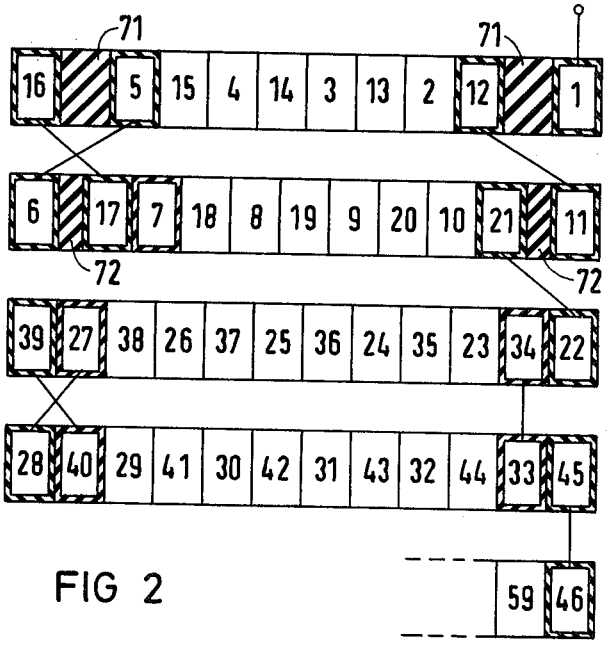
FIG. 2 is a diagrammatic view of a supplemental insulation with decreasing thickness yet with the same number of additionally insulated turns in each of two disc coils.
Figure 3:
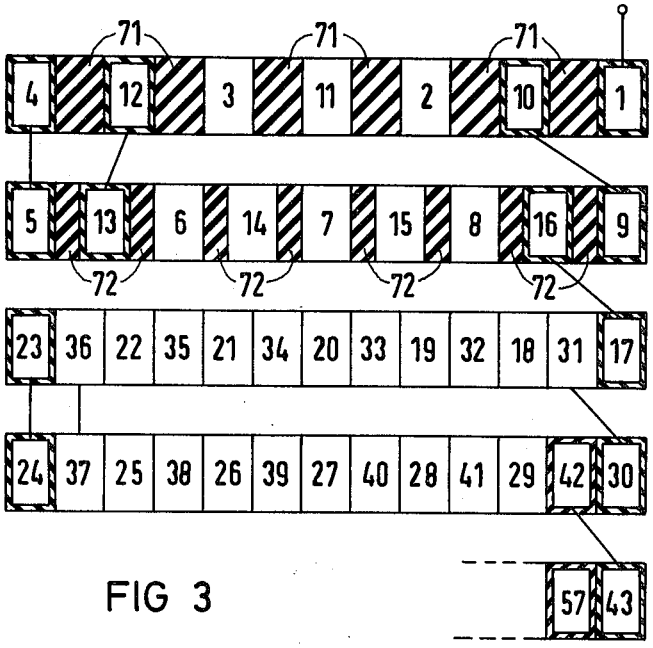
FIG. 3 is a diagrammatic view of a supplemental insulation at all turns in two disc coils.

Conventional, so-called interwound disc coils are wound of two winding conductors which are fed-in simultaneously and spatially parallel, through the turns 1 to n of which the load current flows in the order of the numerals indicated.

A multiple of the turns voltage appears between respective adjacent turns. To determine this voltage, the respective difference of the numbers in the turns under consideration must be multiplied by the voltage of a single turn, which yields the voltage difference between adjacent conductors which occurs for linear distribution, for example for a-c voltage. The voltage differences for surge voltages is several times that of the linear component. In forming the difference, it must merely be taken into consideration that, at the junctions shown, which connect the conductors having numerals different by one, this difference is zero. In forming the difference between adjacent conductors, the number of intermediate connections must therefore be subtracted. For the linear component of the voltage difference calculated in this manner, the continuous insulation 70 applied to the winding conductors is laid out so that it cannot be broken down. Insulation 70 designed exclusively under this aspect do not preclude predischarges in the individual oil wedges or corners between the insulations of adjacent turns. To prevent these predischarges which are critical and to improve the dielectric strength of the high-voltage composed of disc coils supplemental insulations 71 to 73 are provided, the radial thickness of which decreases with increasing reference numeral. Through the arrangement of these supplemental insulations, the safety or reliability of the insulation between mutually adjacent turns, between mutually adjacent disc coils as well as the dielectric strength between farther removed disc coils are harmonized and optimized.

Figure 4:
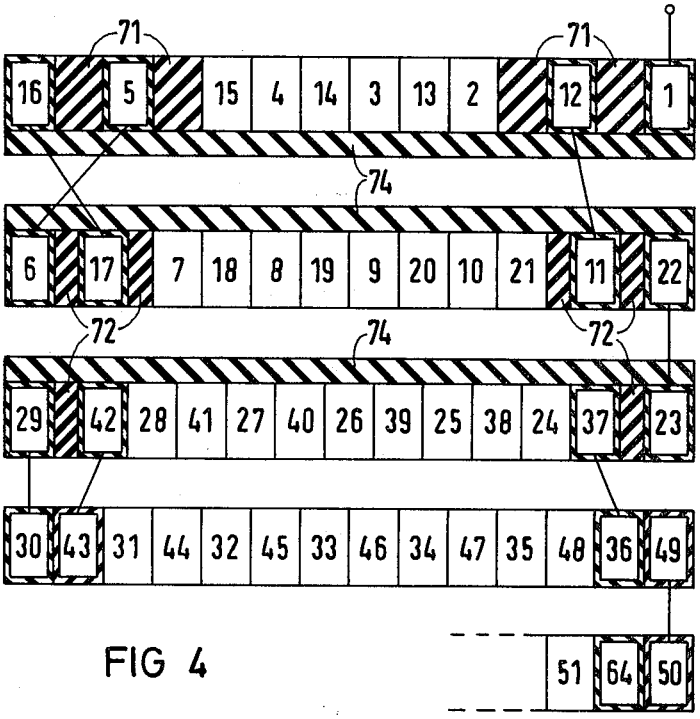
FIG. 4 is a diagrammatic view of a supplemental insulation, gratuated as to thickness and quantity, in three disc coils which have supplemental insulations additionally also in axial direction.
Figure 5:
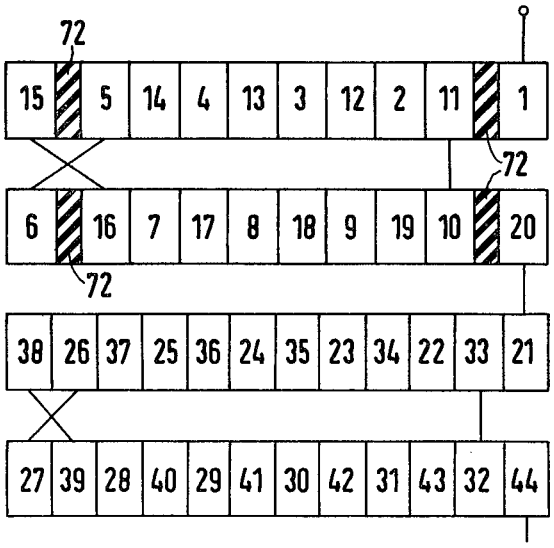
FIGS. 5, 6 and 7 are diagrammatic views of a supplemental insulation of the same thickness for equal numbers of turns in two disc coils, respectively.
Figure 6:
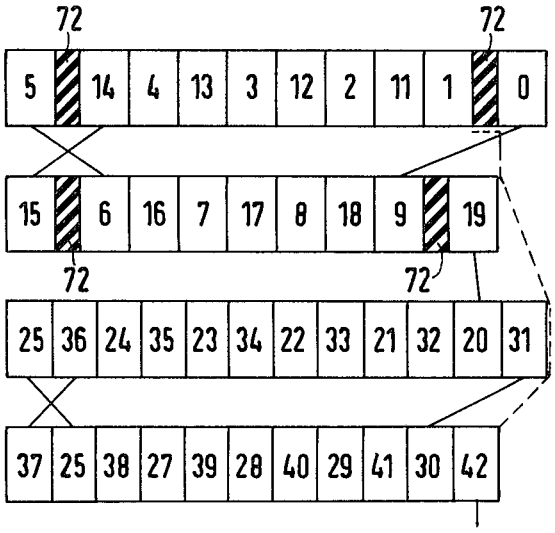

According to the new theory enunciated in co-pending application Ser. No. 346,880 filed Feb. 8, 1982 which relates to an earlier invention by the inventor of the instant application, critical predischarges which can extend radially up to the casing or shell surface and can therefore initiate longitudinal breakdowns, are possible only between edge conductors and adjacent conductors. In the embodiments of the instant application according to FIGS. 2, 5, 6 and 7, supplemental insulations 71 to 73 are therefore provided only there. However, so that the noncritical predischarges occurring between the other conductors do not short the cooling channel because of large axial field components and thereby become critical, the channel insulation must have a correspondingly ample construction. This is accomplished, for example, by increasing the radial cooling channels or by an arrangement according to FIG. 4, wherein disc-shaped supplemental insulations 74 are provided axially between mutually adjacent disc coils, which permit further harmonizing and optimizing of the aforementioned voltage stresses.

Figure 7:
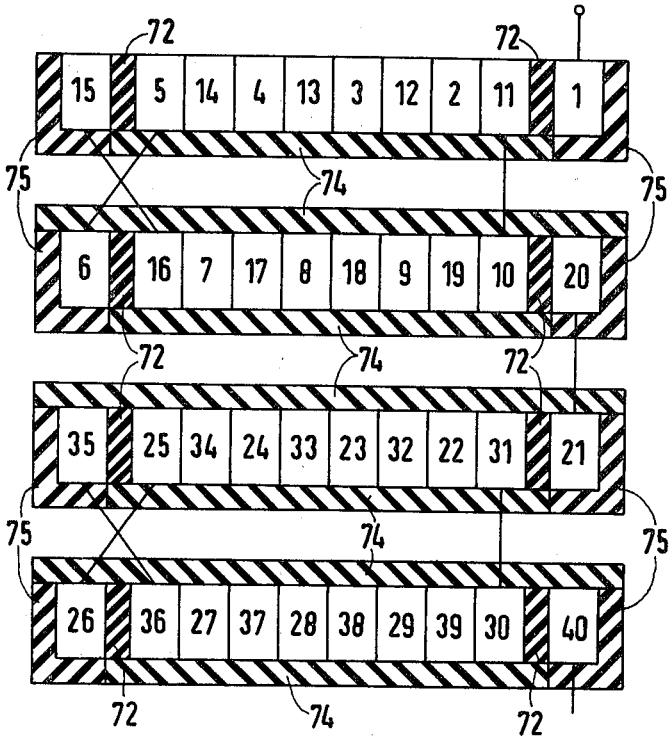

In FIG. 7, a further embodiment with disc-shaped supplemental insulations 74 is shown, wherein additionally the corners facing the casing or shell surfaces of the disc coils are insulated more heavily by angles 75 and wherein the disc-shaped supplemental insulations 74 simultaneously have the function of equalizing discs. The supplemental insulations 71 to 74 arranged radially between mutually adjacent turns reduce, in particular, the field intensity of the electric field in oil wedges or corners formed by mutually adjacent winding conductor edges and thereby ensure that predischarges, which are possible in these oil pockets, are instituted or set in only at considerably higher voltage stresses and; due to the unchanged normal insulation of the winding conductors, permit, nevertheless, a practically unchanged, equally good cooling thereof.

Advantageously, the number of turns is increased in disc coils which, due to the distance thereof from the high-voltage input, require fewer supplemental insulations 71 to 73, and the radial dimensions thereof are consequently smaller than with disc coils with very heavy supplemental insulations 71 to 73.

The two usually simultaneously wound winding conductors in the disc coils then do not yield an even number of turns at all points of the circumference if the connections are shifted accordingly at the circumference from disc coil to disc coil. For this reason, first of all, the number of turns in the individual disc coils are not all even-numbered. Secondly, in the embodiments according to FIGS. 1 to 5, the condition is not clearly recognizable without considering the position in space of the connecting conductors leading from disc coil to disc coil, at which locations critical predischarges for propagation along the winding casing or shell surface and for longitudinal sparkover must be expected. These conditions, however are met in the representation of the embodiment according to FIG. 6 along a dotted line, as shown, along which a longitudinal spark-over will then also set in.

The effect of the invention is based on the discovery that corresponding locations at which longitudinal sparkover conditions are present occur for all interwound coils, especially in the embodiments according to FIGS. 1 to 5, at some nonillustrated location. Thus, the winding cross section shown in FIG. 6 for example, is a nonillustrated location of the circumference of the arrangement according to FIG. 5, but otherwise identical with the winding cross section shown in FIG. 5.

I claim:

1. Disc coil winding of interwound coils formed of winding conductors covered with normal insulation, the winding having a radially inner and a radially outer surface, a plurality of the coils being disposed at an input to the winding, and having respective turns thereof located at the inner and the outer surface of the winding as well as respective turns thereof located radially adjacent thereto, comprising supplemental insulations for reinforcing the normal insulation, said supplemental insulations extending from respective starting locations both between the turn located at the inner surface and the turn adjacent thereto as well as between the turn located at the outer surface and the turn adjacent thereto for protecting at least one edge of the respective turns, the coils having a turn capacitance between respective turns thereof free of said supplemental insulations which is greater than the turn capacitance between the respective turns thereof provided with said supplemental insulations, said supplemental insulations being formed as a spacer having a substantially rectangular cross section disposed radially between the respective turns to be supplementarily insulated, said spacer having a width in axial direction equal to the corresponding width of one of the winding conductors covered with normal insulation.

2. Disc coil winding according to claim 1 wherein the sum of the radial dimensions of said supplemental insulations per disc coil is equal to the radial thickness of the normally insulated winding conductor.

3. Disc coil winding according to claim 1 wherein the sum of the radial dimensions of said supplemental insulations per disc coil is equal to an integral multiple of the radial thickness of the normally insulated winding conductor.

4. Disc coil winding according to claim 1 wherein the conductors are formed of metal and the spacing of the metal conductors between radially adjacent turns established by said supplemental insulation decreases with increasing spacing of the corresponding disc coils from high-voltage input of the winding.

5. Disc Coil winding according to claim 1 wherein said supplemental insulation is formed of solid insulating strips.

6. Disc coil winding according to claim 1 wherein said supplemental insulation is formed of cooling channel strips.

7. Disc coil winding according to claim 1 wherein said supplemental insulation is formed of a combination of solid insulating strips and cooling channel strips.

8. Disc coil winding according to claim 1 wherein said supplemental insulations are disc-shaped serving as equalizing discs, and being disposed in axial direction between adjacent disc coils in a manner that a radial oil channel between a respective pair of adjacent disc coils, having different radial dimensions has the same axial height as a radial oil channel between adjacent disc coils having the same radial dimension.

* * * * *